US005398843A

United States Patent [19]

Warden et al.

[11] Patent Number: 5,398,843

[45] Date of Patent: Mar. 21, 1995

[54] DRINK-THROUGH LID FOR DISPOSABLE CUP

[75] Inventors: Jeffrey A. Warden, Southfield; Anton I. Letica, Rochester Hills, both of Mich.

[73] Assignee: Letica Corporation, Rochester, Mich.

[21] Appl. No.: 160,244

[22] Filed: Dec. 2, 1993

[51] Int. Cl.[6] ..... A47G 19/22; B65D 51/18

[52] U.S. Cl. ..... 220/711; 220/703; 220/713; 220/254

[58] Field of Search ..... 220/711, 703, 712, 713, 220/714, 254

[56] References Cited

U.S. PATENT DOCUMENTS

| | | | |
|---|---|---|---|
| Re. 31,650 | 8/1984 | Scattaregia . | |
| 3,459,324 | 8/1969 | Miller . | |
| 3,800,999 | 4/1974 | Serritella . | |
| 3,806,023 | 4/1974 | Barnett . | |
| 3,977,559 | 8/1976 | Lombardi . | |
| 3,994,411 | 11/1976 | Elfelt et al. . | |
| 4,090,660 | 5/1978 | Schramm et al. . | |
| 4,113,135 | 9/1978 | Yamazaki | 220/268 |
| 4,184,604 | 1/1980 | Amberg et al. | 220/254 |
| 4,285,442 | 8/1981 | Wedzik . | |
| 4,345,695 | 8/1982 | Galloway et al. | 220/254 |
| 4,350,260 | 9/1982 | Prueher | 220/254 |
| 4,412,629 | 11/1983 | Dart et al. . | |
| 4,438,865 | 3/1984 | Scateregia . | |
| 4,441,623 | 4/1984 | Antoniak | 220/711 |
| 4,582,214 | 4/1986 | Dart et al. | 220/713 |
| 4,589,569 | 5/1986 | Clements | 220/380 |
| 4,615,459 | 10/1986 | Clements | 220/254 |
| 4,741,450 | 5/1988 | Braude . | |
| 4,898,299 | 2/1990 | Herbst et al. | 220/711 |
| 4,986,437 | 1/1991 | Farmer | 220/713 |
| 5,183,172 | 2/1993 | Boller | 220/270 |
| 5,253,781 | 10/1993 | Van Melle et al. . | |

*Primary Examiner*—Allan N. Shoap
*Assistant Examiner*—Vanessa Caretto
*Attorney, Agent, or Firm*—Young, MacFarlane & Wood

[57] ABSTRACT

A molded plastic lid of the drink-through type for use in connection with a conventional beverage cup. The lid exhibits a cup-engaging rim and, radially inwardly thereof, a raised crown portion having a side wall and a top. The top is generally flat but has formed therein a centrally located recess, the floor of which extends laterally to the side walls and which is at all times above the maximum fill line of the cup during normal operation. The recess exhibits a structure which may be depressed into a stable inverted condition which provides an enlarged drink-through aperture immediately adjacent the side wall.

6 Claims, 2 Drawing Sheets

DRINK-THROUGH LID FOR DISPOSABLE CUP

FIELD OF THE INVENTION

This invention is in the field of molded plastic lids for disposable drink cups, particularly those lids which are provided with means to permit tile user to drink a beverage from the cup without removing tile lid.

BACKGROUND OF THE INVENTION

Hot and cold beverages are generally sold or served in disposable cups made of paper or plastic. Such cups are generally characterized by a tapering cylindrical shape and a circular lip which defines a maximum fill line. It is common to receive the beverage and cup in or from a fast food establishment, drink or food bar, cafeteria or the like, along with a lid which inhibits spillage and thermal transfer.

Various popular lids provide a "drink-through" feature wherein the purchaser may drink the beverage from the cup without removing the lid. One way to provide a drink-through feature is to form a wedge-shaped tear back tab in the lid which may be torn or otherwise separated from the peripheral edge of tile lid back toward the center. Lids exhibiting these tear back tabs are shown in U.S. Pat. No. 3,977,559 to Lombardi, U.S. Pat. No. 3,994,411 to Elfelt et al and U.S. Pat. No. 4,090,660 to Schram et al.

Another type of drink-through lid includes a pivoted section inboard of the periphery which may be pushed downwardly; toward the interior of the cup. Examples of the former are illustrated in U.S. Pat. No. 4,113,135 to Yamazaki and U.S. Pat. No. 4,138,033 to Payne et al. Both the Yamazaki and Payne et al lids are of the plug-fit design wherein the center of the lid is recessed into the interior of the cup when the lid is in place on the lip of the cup. Accordingly, the drink-through hatch or flap is typically below the maximum fill line of the cup and the act of opening the drink-through aperture may cause a portion of the lid surface to be pushed into the contents of the lid. This can cause inadvertent and undesirable spillage.

SUMMARY OF THE INVENTION

The present invention provides a drink-through molded plastic lid intended for use in combination with beverage cups of the type laving a circular lip which defines a maximum fill line wherein the drink-through aperture is at all times above the maximum fill line of the cup so as to substantially reduce the likelihood of inadvertent and undesirable spillage.

In general, the lid of the present invention comprises the integral combination of an annular rim portion having an undercut to conform to and sealingly engage the lip of a conventional disposable drink cup, and a raised crown portion having a continuous side wall, a generally flat top and positioned inwardly from the annular rim. A collector recess having a flat recess floor is formed generally centrally of the top but, because the depth of the recess is less than the height of the crown, the recess floor lies above the annular rim. The recess exhibits a lateral extension with upwardly extending opposite walls which run essentially to but not through the side wall and a drink-through aperture is formed in the extension adjacent the side wall. The recess further defines an extension floor between the upwardly extending opposite walls.

The drink-through aperture may be configured or provided in various ways including a pre-cut hole, a flap, a punch-out section or a tear flap. However, in the preferred form, the drink-through aperture is formed by means of a raised structure having a first stable condition or configuration in which it lies essentially just above the level of the recess floor and a second stable condition, reached simply by pushing on the top of the structure, in which the structure inverts to a position just below the floor but nevertheless above the annular rim. The manual operation which urges the aperture structure from the first or "seal" condition to the second or "open" condition may also partially separate the structure from the side wall so as to either initiate or, alternatively, increase the separation of the material of the aperture structure from the adjacent side wall to facilitate the flow of the beverage from the cup to the consumer.

The invention and its various advantages may be best understood from a reading of the following specification which describes two illustrative and alternative embodiments of the invention.

DETAILED DESCRIPTION OF THE ILLUSTRATIVE EMBODIMENTS

Figure 1:
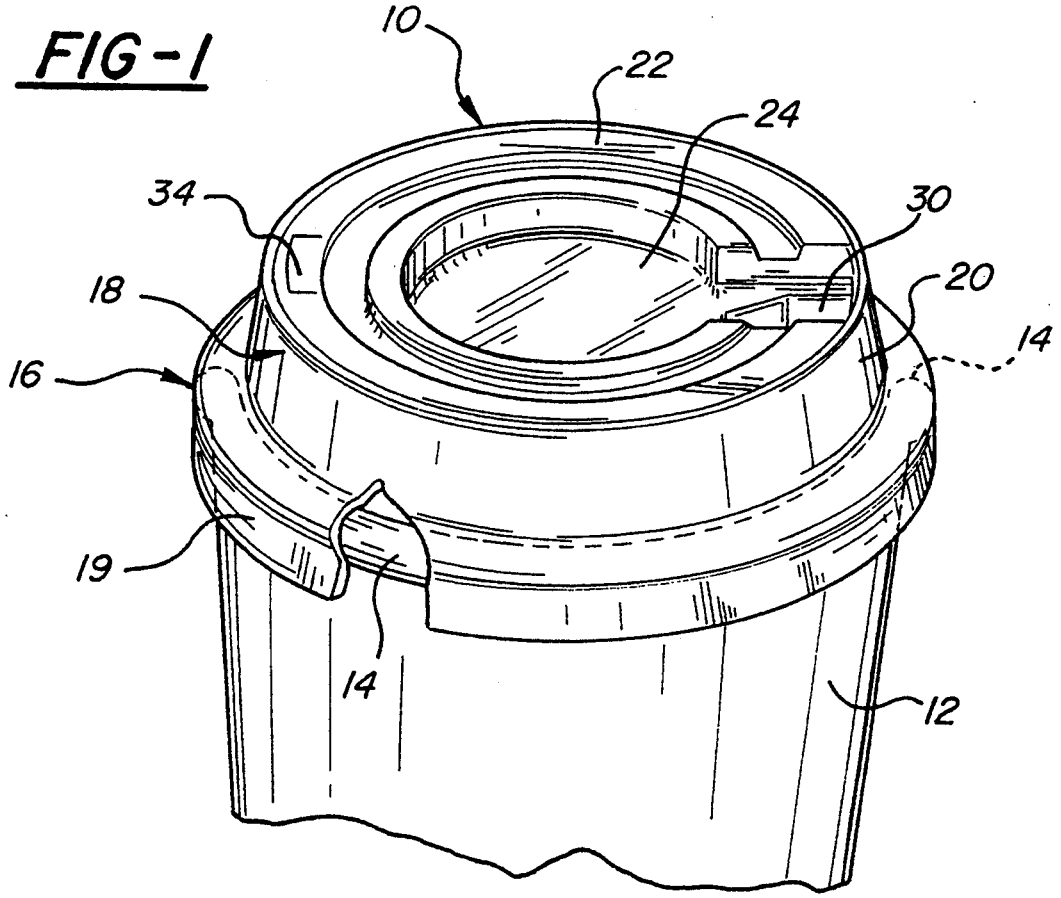
FIG. 1 is a perspective view of the invention embodied in a drink-through molded plastic lid for a conventional fast food beverage cup.

FIG. 1 illustrates a molded plastic lid 10 of the drink-through type disposed on a conventional coated paper drink cup 12 of the type which is conventionally available at fast food establishments, food and drink bars, cafeterias, clubs and numerous other establishments and businesses which serve hot and cold beverages and related food products. Cup 12 is of paper construction, is of tapering cylindrical configuration and exhibits at the upper periphery thereof a circular lip 14, typically rolled over to form a bead, the plane of which represents a maximum fill line for the cup 12. The actual construction of the cup 12 may vary substantially and include, in addition to paper cups having rolled rim beads, Styrofoam and other molded plastic cups having unbeaded lips.

The lid 10 is a one-piece thermoplastic structure made from a thin sheet of polystyrene or any other suitable thermoformable organic material and includes an annular rim portion 16 which is adapted to sealingly engage and conform to the lip 14 of the cup 12 when properly placed thereon. The lid 10 is undercut or reduced slightly in diameter below the rim portion 16 and then flares outwardly in a short skirt portion 19 which facilitates both placing the lid on the cup 12 and removing it from the cup if that is desired. Above and integral with the rim portion 16 is a crown portion 18 defined by a continuous side wall 20 which is integral with a generally flat circular top 22. The side wall 20 tapers slightly from the rim 16 to the top 22.

Formed within the top 22 is a generally circular and centrally located collector recess 24, the depth of which is approximately half the height of the crown portion 18. The recess 24 is generally keyhole-shaped and, therefore, has a lateral extension 26 which shares a common floor with the central section 24. The lateral section extends to but not through the side wall 20. A collector groove 28 is formed in the top of lid 10 with opposite ends terminating at the recess 24.

Figure 2:
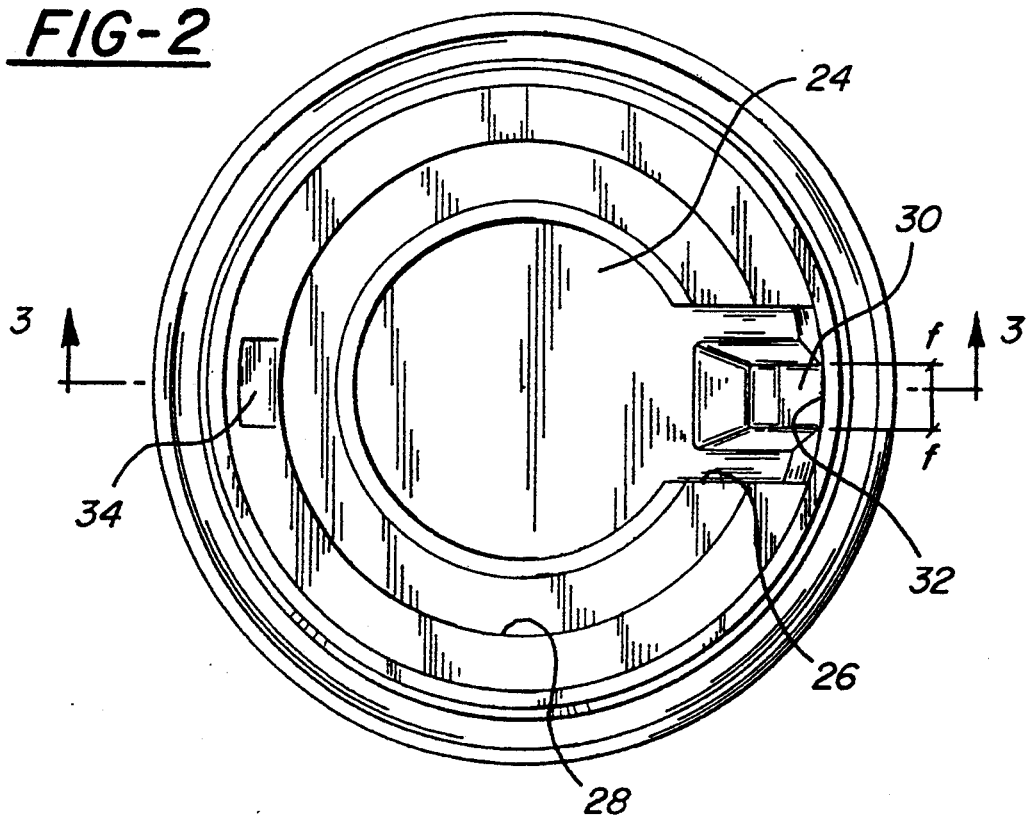
FIG. 2 is a plan view of the lid of FIG. 1.
Figure 3:
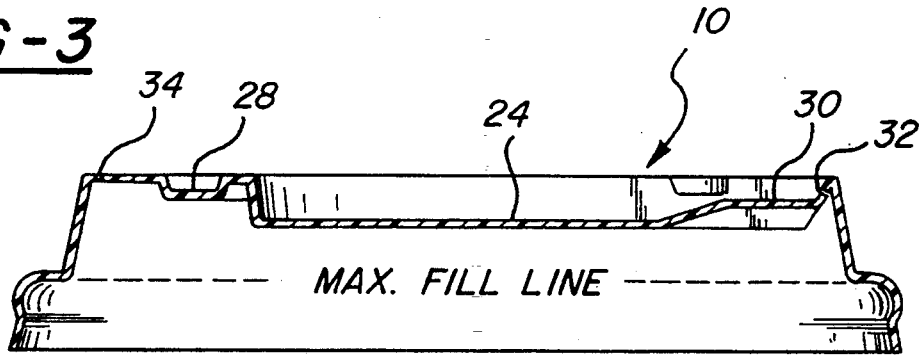
FIG. 3 is a side view in section of the lid of FIG. 2 with the drink-through aperture in the "seal" condition.

A drink-through aperture is provided in the floor of the extension 26 immediately adjacent the side walls 20 by means of a truncated trapezoidal structure 30 which, as best shown in FIGS. 2 and 3, has a flat top and side surfaces which rise above the floor of the recess 24. The top of structure 30 is partially separated from the side wall structure 20 by means of a through-fault 32, typically formed by die cutting, extending between the lines f—f as shown in FIG. 2.

Figure 4:
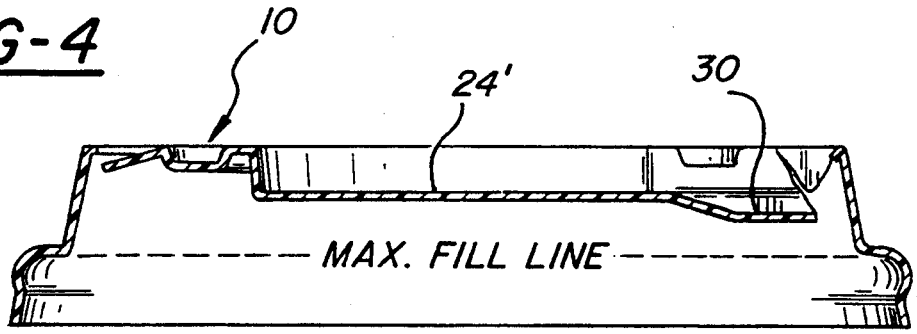
FIG. 4 is a side view in section of the lid of FIG. 2 with the aperture structure in a "open" condition.

The truncated trapezoidal structure 30 is so designed as to exhibit a first stable condition, shown in FIG. 3, in which the structure is disposed above the floor of the recess, and a second stable condition, represented by FIG. 4, in which the structure 30 is pushed below the level of the recess floor but, nevertheless, above the maximum fill line represented by the plane of the lip of the cup 12. The structure 30 can be readily moved from the first or "seal" condition shown in FIG. 3 to the second or "open" condition shown in FIG. 4 simply by pressing, on the top surface of the structure 30 with one's finger. The structure 30 essentially inverts in the manner of a Belleville washer or "snap ring" to substantially enlarge the drink-through aperture formed by the through-fault 32. Moreover, the act of operating the structure 30 from the FIG. 3 condition to the FIG. 4 condition may also extend the fault line down the sides of the structure immediately contiguous the side wall 20; i.e., beyond the lines represented by f—f in FIG. 2.

A vent 34 is formed in the lid 10 opposite the drink-through aperture structure 30 to facilitate the flow of fluid from the cup 12 to the consumer.

Figure 5:
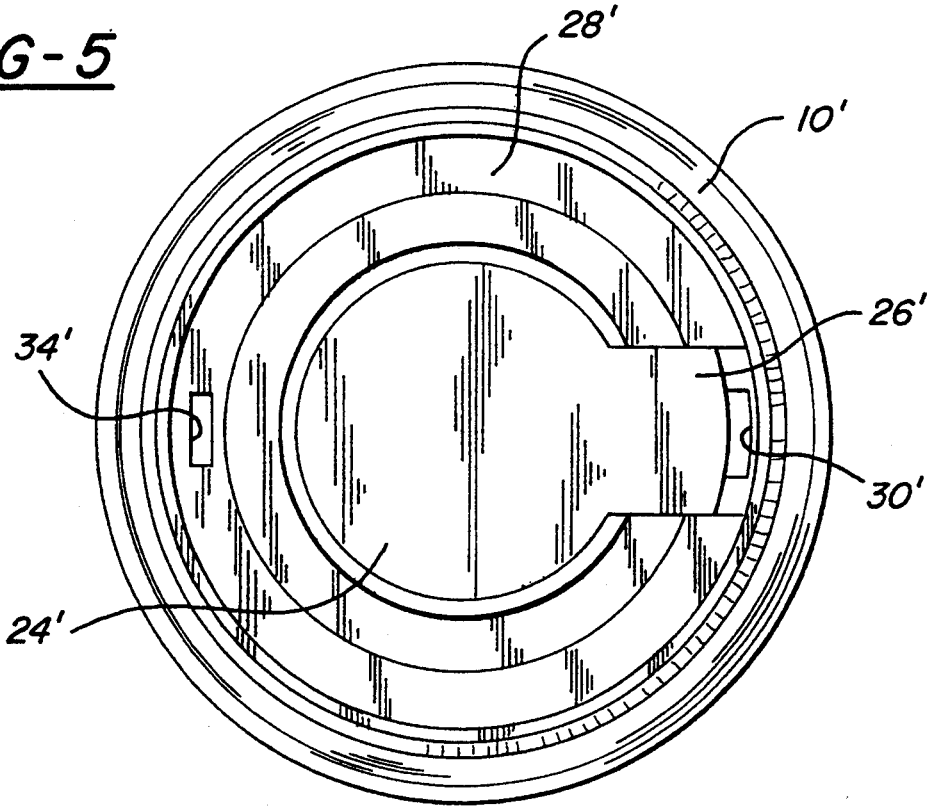
FIG. 5 is a plan view of an alternative embodiment.

A second alternative embodiment is shown in FIG. 5 wherein reference numerals corresponding to those found in FIGS. 1–4 are used in "primed" fashion to denominate corresponding structure. The lid 10′ of FIG. 5 differs from the lid 10 of FIGS. 1–4 only in the substitution of a pre-cut aperture 30′ for the invertible structure 30 of the embodiments of FIGS. 1–4.

MANUFACTURE MODE AND OPERATION

The lids 10 and 10′ described above are preferably formed in mass production from extruded sheet material of polystyrene or other thin readily deformable thermoplastic materials. Such material may be extruded or otherwise formed in thin resilient sheets which may be applied to hot vacuum forming dies to be pulled by vacuum into the configuration of the die and thereafter removed from the die and cut from the surrounding sheet stock to form individual lids 10 and 10′. The apertures and through-faults may be formed by die cutting at the same time the lids are removed from the surrounding sheet material. The sheet material may typically be recovered, ground and recycled as part of a mix with virgin material to form additional lids.

In operation the cup 12 is filled by a vendor with a suitable consumable beverage such as coffee and the lid 10 or 10′ is properly applied to the lip 14 of the cup 12. Because of the dimension of the crown 18, the floor of the recess 24 or 24′ is at all times above the maximum fill line of the cup 12 as shown in FIGS. 3 and 4. When the consumer is ready to drink from the cup 12, he/she presses his/her finger on the top surface of the structure 30 to cause it to invert from the "sealed" condition shown in FIG. 3 to the "opened" condition shown in FIG. 4. The consumer may then drink through the aperture produced by the manual manipulation of the structure 30, the collector recess 24 forming a convenient accommodation for the consumer's upper lip and nose. The lower lip typically contacts the side wall 20 immediately adjacent the aperture structure 30. The structure of the lid 10 is such that substantially all of the beverage may be consumed or drained from the container. The recess 24 forms a convenient collector and drain for any beverage which may escape from the vent 34. The groove 28 acts as a collector and extends around the entire top surface of the lid 10 to the recess 24 so as to empty any collected material into the recess and, through the apertures 30 or 30′ back into the cup 12.

When used with beaded-rim cups, the subject device does not require a plug-fit and, by reason of the crown 18, places the floor of the drain recess 24 and the aperture-forming structure 30 above the maximum fill line of the cup 12 at all times.

The fault area 32 may be and preferably is faulted entirely through the material of the lid upon manufacture thereof. Alternatively, a thin section, structurally weakened area may be provided by means of an embossment or impression in the molding operation. If partially faulted through between f—f, the adjacent tear lines may be defined and enhanced by means of weakened sections, embossments or grooves. Although a thermoformed plastic material is, at the present time, the commercially preferred material, various equivalents such as compressed paper and some metals are technically feasible. Typical dimensions for a commercially practical lid are approximately $3\frac{1}{4}$ inch in overall diameter, a crown height of between about $\frac{3}{8}$inch and $\frac{1}{2}$ inch, a recess diameter of about $1\frac{1}{2}$ inches and a recess depth of about $\frac{1}{4}$ of an inch.

We claim:

1. A drink-through lid for beverage cups of the type having a circular lip which defines a maximum fill line comprising the integral combination of:

an annular rim portion having to conform to and sealingly engage the cup lip; and a raised crown portion contiguously inward of said rim portion;

said crown portion having a continuous peripheral circular side wall and a top, a collector recess formed generally centrally of said top and defining a recess floor which lies substantially below said top but above the annular rim, said recess having a lateral extension with upwardly extending opposite walls which run essentially to said side wall and define an extension floor between said walls at least approximately co-planar with said recess floor; and drink-through aperture means providing an opening in said lid, said aperture means formed in said extension floor adjacent said side wall and comprising an integral structure which normally assumes a first stable condition above the recess floor but which is deformable into a second inverted stable condition below the recess floor, above the annular rim, and partially separated from the side wall immediately adjacent said side wall.

2. A drink-through lid as defined in claim 1 wherein the aperture means is partially through-faulted from the material of the side wall.

3. A drink-through lid as defined in claim 1 further including a vent aperture disposed in the top opposite the drink-through aperture means.

4. A drink-through lid as defined in claim 1 which is manufactured of thermoplastic material.

5. A drink-through lid as defined in claim 1 wherein the height of the crown is between about $\frac{3}{8}$ inch and $\frac{1}{2}$ inch.

6. A drink-through lid for beverage cups of the type having a circular lip which defines a maximum fill line comprising the integral combination of:

an annular rim portion having an undercut to conform to and sealingly engage the cup lip;

a raised crown portion contiguously inward of said rim portion, said crown portion having a continuous peripheral, circular side wall and a top, a circular recess formed generally centrally of said top and defining a recess floor which lies above the annular rim, said recess having a lateral extension with upwardly extending opposite walls which run essentially to said side wall and define an extension floor at least approximately coplanar with said recess floor; and a drink through aperture formed in said extension floor adjacent said side wall.

* * * * *